US007680422B2

(12) United States Patent
Nakaue et al.

(10) Patent No.: US 7,680,422 B2
(45) Date of Patent: Mar. 16, 2010

(54) IMAGE FORMING APPARATUS AND IMAGE FORMING METHOD

(75) Inventors: Takahisa Nakaue, Osaka (JP); Takaaki Kamei, Osaka (JP)

(73) Assignee: Kyocera Mita Corporation (JP)

( * ) Notice: Subject to any disclaimer, the term of this patent is extended or adjusted under 35 U.S.C. 154(b) by 289 days.

(21) Appl. No.: 11/789,261

(22) Filed: Apr. 24, 2007

(65) Prior Publication Data

US 2007/0253721 A1 Nov. 1, 2007

(30) Foreign Application Priority Data

Apr. 28, 2006 (JP) ..... 2006-126804

(51) Int. Cl.
*G03G 15/00* (2006.01)

(52) U.S. Cl. ..... 399/44; 399/27; 399/39; 399/53

(58) Field of Classification Search ..... 399/44, 399/94

See application file for complete search history.

(56) References Cited

U.S. PATENT DOCUMENTS 4,888,618 A * 12/1989 Ishikawa ..... 399/39
2005/0191069 A1 * 9/2005 Yamaki et al. ..... 399/44

* cited by examiner

*Primary Examiner*—David M Gray
*Assistant Examiner*—Roy Yi
(74) *Attorney, Agent, or Firm*—Gerald E. Hespos; Anthony J. Casella

(57) ABSTRACT

An image forming apparatus which adjusts toner density in a developing device according to humidity. However, an image quality may decrease if the humidity changes between the time when a power source is turned off and the time when the power source is turned on. Accordingly, the image forming apparatus includes an absolute humidity calculator and a toner density controller for changing the toner density in the developing device in accordance with a difference between the absolute humidities. A storage controller controls the storing of an absolute humidity in a storage portion; and a toner removal controller controls the removal of residual toner particles from the developing device if a difference between an absolute humidity detected by the humidity detector when the power source is turned on and an absolute humidity stored in the storage portion is more than a predetermined value.

7 Claims, 6 Drawing Sheets

IMAGE FORMING APPARATUS AND IMAGE FORMING METHOD

BACKGROUND OF THE INVENTION

1. Field of the Invention

The present invention relates to an image forming apparatus which adjusts a toner density in accordance with humidity, and an image forming method.

2. Description of the Related Art

Conventionally, there has been a widely known image forming apparatus adopting an electrophotographic method, in which an image is formed on a recording sheet by performing an exposing operation to a photoconductive drum whose surface is uniformly charged with electricity based on a predetermined image data to form an electrostatic latent image on the surface of the photoconductive drum, forming a toner image by a developing device which develops an electrostatic latent image by charged toner particles, and directly or indirectly transferring the toner image from the photoconductive drum to the recording sheet and fixing the toner image.

In such image forming apparatus, a developing device stores developer particles including carrier and toner particles. The image density is increased by increasing a ratio of toner particles included in the developer i.e. the toner density, and the image density is decreased by lowering the toner density. However, the amount of electric charge to toner particles is changed in accordance with the humidity. When the humidity is high, the amount of electric charge is lowered. Accordingly, toner particles become easily separated from carrier particles, and the density of an image is increased. On the other hand, when the humidity is low, the amount of electric charge is increased so that toner particles become hardly separated from carrier particles, and the density of an image is decreased.

Thus, there has been a known image forming apparatus (for example, refer to Japanese Unexamined Patent Publication No. 2000-47438) which decreases the toner density of a developing device to decrease the density of an image when the humidity is high, and increases the toner density of the developing device to increase the density of an image when the humidity is low, so that the change of image density due to the change of humidity can be adjusted.

Meanwhile, in the above-described image forming apparatus, there has been a disadvantage that an appropriate image density cannot be obtained and the image quality is degraded when a humidity in a power-off state and a humidity in a power-on state are greatly different from each other. For example, it is taken in consideration the case where a power source of the image forming apparatus is turned off under an environment where an air conditioner is turned on in summer, and the power source of the image forming apparatus is turned on next day while the air conditioner is not turned on. In such a case, the toner density in the developing device is increased since the humidity is low when the power source of the image forming apparatus is turned off on the previous day. Then, on the next day, when the power source of the image forming apparatus is turned on, toner particles with high density at the time when the power source is turned off on the previous day remain in the developing device even though the humidity is high. At this time, even if it is tried to adjust the image density by decreasing the toner density, the image density is not adjusted until all of the toner particles with high density remained in the developing device are used. Therefore, there existed a disadvantage that an appropriate image density cannot be obtained and the image quality is degraded.

SUMMARY OF THE INVENTION

The present invention was made in order to solve the above-described problems, and its object is to provide and image forming apparatus capable of reducing degradation of the image quality occurred in an image forming apparatus which adjusts a toner density in the developing device in accordance with the humidity in the developing device in the case where a humidity in a power-off state and humidity in a power-on state are different from each other.

An image forming apparatus according to one aspect of the present invention comprises: a developing device storing developer particles including toner particles; a developing portion provided with a photoconductive drum for forming a toner image by allowing charged toner particles from the developing device to adhere onto an electrostatic latent image formed on the photoconductive drum; a humidity detector for detecting an absolute humidity; a toner density controller for changing the toner density in the developing device in accordance with a difference between absolute humidities detected by the humidity detector; a storage portion; a storage controller for controlling the storing of an absolute humidity detected by the humidity detector to the storage portion; a power switching portion for turning on and off a power source of the apparatus; and a toner removal controller for controlling the removing of residual toner particles from the developing device if a difference between an absolute humidity detected by the humidity detector when the power source is turned on and an absolute humidity stored in the storage portion is more than a predetermined difference value.

An image forming method according to another aspect of the present invention comprises: a first humidity detecting step of detecting an absolute humidity; a toner intensity controlling step of changing, in accordance with a change in the absolute humidity detected in the first humidity detecting step, the toner density of a developing device for storing developer particles including toner particles; a storage controlling step of storing in a storage portion an absolute humidity detected in the first humidity detecting step; a power turning-off step of turning off a power source; a power turning-on step of turning on the power source; a second humidity detecting step of detecting an absolute humidity when the power source is turned on in the power turning-on step; and a toner removing step of removing residual toner particles from the developing device when a difference between an absolute humidity detected in the second humidity detecting step and an absolute humidity stored in the storage portion is more than a predetermined difference value.

According to the aforementioned configurations, an image forming is performed by allowing charged toner particles to be adhered onto an electrostatic latent image formed on the photoconductive drum to thereby form a toner image, and transferring the toner image to a recording sheet. Further, the toner density in the developing device for storing developer particles including toner particles is changed in accordance with a change in an absolute humidity. Accordingly, an effect of the change in humidity with respect to the image density is reduced. Then, an absolute humidity detected by the humidity detecting step is stored in the storage portion. Further, if a difference between an absolute humidity detected by the humidity detecting step and an absolute humidity stored in the storage portion is more than a predetermined difference value when the power source is turned on, toner particles remained in the developing device are removed.

Accordingly, the toner removing device removes from the developing device for storing developer particles including toner particles toner particles whose toner density is adjusted in accordance with a condition of the absolute humidity being different from the present condition before the power source is turned off. Consequently, degradation of an image quality which occurs when a humidity at the time of turning off the power source and a humidity at the time of turning on the power source has a difference can be reduced.

These and other objects, features and advantages of the present invention will become more apparent upon reading of the following detailed description along with the accompanied drawings.

DETAILED DESCRIPTION OF THE PREFERRED EMBODIMENTS

Figure 1:
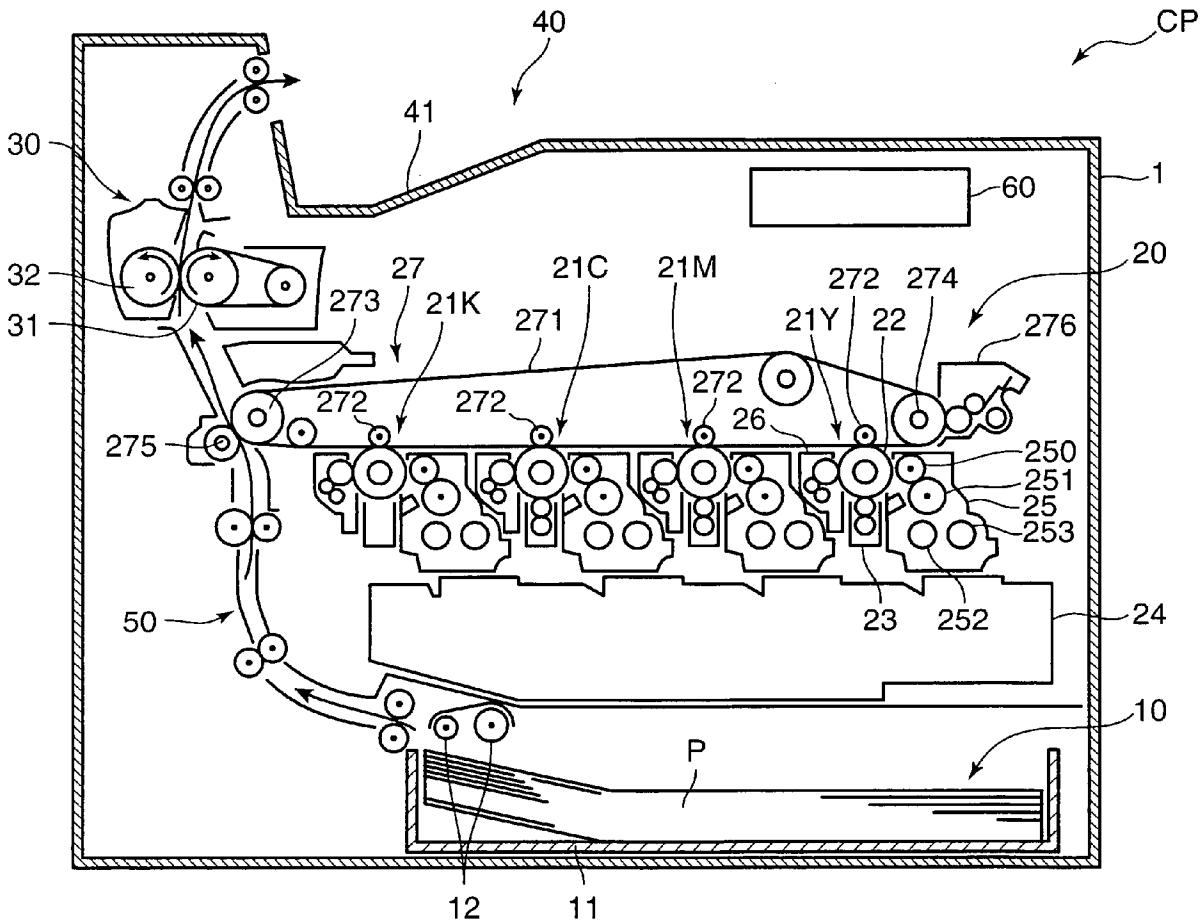
FIG. 1 is a view showing a schematic configuration of a color printer apparatus according an embodiment.

Hereinafter, an embodiment of the present invention will be described with reference to the drawings. It should be noted that components having the same reference signs in the drawings have the same configurations, and descriptions of the components will be abbreviated. Further, the embodiment described herebelow is an example embodying the present invention and does not have a feature of limiting the scope of the present invention.

The developing device according to the present embodiment is adopted in an image forming apparatus such as a copying machine, a printer apparatus and a facsimile apparatus. As an example, the case of adopting the developing device to a color printer apparatus will be described herebelow.

First, a color printer apparatus which is an example of an image forming apparatus will be described. FIG. 1 is a view showing a schematic configuration of a color printer apparatus according to the embodiment. In FIG. 1, the color printer apparatus CP includes a sheet storing portion 10, an image forming portion 20, a fixing device 30, a sheet discharging portion 40, a sheet conveying passage 50 and a controller 60. The sheet storing portion 10, the image forming portion 20, the fixing device 30, the sheet conveying passage 50 and the controller 60 are provided in an apparatus main body 1 having a box-like shape. The sheet discharging portion 40 is provided on a top portion of the apparatus main body 1.

The sheet storing portion 10 stores a sheet P (recording sheet) as an example of a transferred member used in a printing processing, and the controller 60 controls the sheet storing portion 10 to send out and feed a sheet P. In the sheet storing portion 10, there is provided the predetermined numbers of sheet cassette 11 (one in the present embodiment) detachably with respect to the apparatus main body 1. At an upstream end of the sheet cassette 11 (on upper left side of the sheet cassette 11 in FIG. 1), there is provided the pickup roller 12 for sending out a sheet P from a stack of sheets one after another. A sheet P which is sent out from the sheet cassette 11 by the driving of the pickup roller 12 is fed to the sheet conveying passage 50.

The image forming portion 20 is controlled by the controller 60 to perform a transferring processing of an image to a sheet P which is conveyed one after another from the stack of sheets stored in the sheet storing portion 10 based on an image signal received from a computer or the like by an unillustrated communication I/F circuit. The image forming portion 20 includes an image forming unit 21 for forming a toner image and a transferring device 27 (transferring portion) for transferring the toner image formed by the image forming unit 21 to a sheet P.

The image forming unit 21 includes a yellow-image forming unit 21Y, a magenta-image forming unit 21M, a cyan-image forming unit 21C and a black-image forming unit 21K, which are aligned in a substantially horizontal direction consecutively from an upstream side (right side on the drawing sheet of FIG. 1) to a downstream side. Further, at lower positions of the respective units, there is provided an exposing unit 24. The units 21Y, 21M, 21C and 21K are mounted and positioned in a predetermined relative positional relationship with respect to respective devices in the apparatus main body 1. In the present specification, reference signs without subscripts are shown when they are collectively described, and reference signs with subscript are shown when an individual configuration is indicated.

Each of the units 21Y, 21M, 21C and 21K includes a photoconductive drum 22, a charging device 23, a developing device 25 (developing portion) and a cleaning device 26 (toner removing device). The photoconductive drum 22 is provided rotatably about a drum shaft which extends in forward and backward directions (the directions perpendicular to the drawing sheet of FIG. 1) Further, the charging device 23, the developing device 25 and the cleaning device 26 are provided in such a manner that they are aligned along the peripheral surface of the photoconductive drum 22 from an immediate lower position of the photoconductive drum 22 toward a counter-clockwise direction which is a rotational direction of the photoconductive drum 22.

The photoconductive drum 22 allows an electrostatic latent image and a toner image (visible image) in accordance with the electrostatic latent image to be formed on its peripheral surface. The charging device 23 forms a uniform electric charge on the peripheral surface of the photoconductive drum 22 which is rotated in a counter-clockwise direction about the drum shaft. For example, the charging device 23 includes a charging roller whose peripheral surface comes in contact with the peripheral surface of the photoconductive drum 22 and is drivenly rotated to apply an electric charge to the photoconductive drum 22.

The developing device 25 supplies toner particles to the peripheral surface of the photoconductive drum 22 to allow the toner particles to be adhered to a portion of the peripheral surface where an electrostatic latent image is formed. Accordingly, a toner image is formed on the peripheral surface of photoconductive drum 22. In the present embodiment, in order to correspond to a color printing, yellow toner particles are stored in the developing device 25Y of the yellow-image forming unit 21Y. Magenta toner particles are stored in the developing device 25M of the magenta-image forming unit 21M. Cyan toner particles are stored in the developing device 25C of the cyan-image forming unit 21C. Black toner particles are stored in the developing device 25K of the black-image forming unit 21K. The developing device 25 will be described in detail hereinafter.

The cleaning device 26 removes and cleans toner particles remained on the peripheral surface of the photoconductive drum 22 after the transferring processing is performed. The peripheral surface cleaned by the cleaning device 26 is moved to the charging device 23 again for the next image forming processing.

The exposing unit 24 irradiates a laser light provided with difference in strength based on image data to the peripheral surface of the rotated photoconductive drum 22 through a space between the charging device 23 and the developing device 25 to form an electrostatic latent image on the peripheral surface of the photoconductive drum 22. To correspond to a color printing, the exposing unit 24 irradiates laser lights corresponding to the respective colors of yellow, magenta, cyan and black to the photoconductive drums 22Y, 22M, 22C, 22K of the respective image forming units 21Y, 21M, 21C, 21K. When a laser light is irradiated to the charged peripheral surface of the photoconductive drum 22, electric charges of the irradiated portion is eliminated in accordance with strength of the laser light. Accordingly, an electrostatic latent image is formed on the peripheral surface of the photoconductive drum 22. An image data is generated by applying a processing such as a known color correction processing to an image signal transmitted from an external appliance such as a computer and received by an unillustrated interface circuit. The controller 60 generates image data corresponding to respective developing colors including yellow, magenta, cyan and black.

The transferring device 27 transfers a toner image formed on the photoconductive drum 22 by the developing device 25 to a sheet P. The transferring device 27 includes an intermediate transferring belt 271 (transferring belt), primary transferring roller 272, a driving roller 273, a driven roller 274 and a secondary transferring roller 275. The intermediate transferring belt 271 is an endless belt, and is extendingly provided at an intermediate upper position from the respective units 21Y, 21M, 21C, 21K with the primary transferring roller 272, the driving roller 273 and the driven roller 274 so that it can be rotated in a clockwise direction by a rotational driving force by the driving roller 273. The primary transferring rollers 272 are provided in such a manner that they face respectively with the respective photoconductive drums 22Y, 22M, 22C, 22K of the units 21Y, 21M, 21C, 22K, and are positioned so as to press the intermediate transferring belt 271 and prevent intermediate transferring belt 271 from being spaced apart from the photoconductive drums 22. The secondary transferring roller 275 is located at a position where it faces the driving roller 273 at the outer peripheral surface of the intermediate transferring belt 271.

The driving roller 273 is grounded. Each primary transferring roller 272 is applied with a voltage having an opposite polarity with respect to the charged polarity of toner particles as a primary transfer bias while a toner image in an image area is primarily transferred from the photoconductive drum 22 to the intermediate transferring belt 271. Further, the secondary transferring roller 275 is applied with a voltage having an opposite polarity with respect to a charged polarity of toner particles as a secondary transfer bias while a toner image on the intermediate transferring belt 271 is secondarily transferred to the sheet P. As described above, the color printer apparatus CP according to the embodiment adopts an indirect transferring method.

On the right side of the driven roller 274, there is provided an intermediate transferring belt cleaning device 276 (toner removing device). The intermediate transferring belt cleaning device 276 removes toner particles remained on the surface of the intermediate transferring belt 271 after a toner image is transferred to the sheet P. The intermediate transferring belt 271 cleaned in such a manner is supplied to the photoconductive drum 22.

The fixing device 30 performs a fixing processing by heat to a toner image on a sheet P to which a transferring processing is performed by the image forming portion 20 in accordance with a control of the controller 60. The fixing device 30 forms an image by fixing the toner image transferred to the sheet P. The fixing device 30 includes a heating roller 31 and a pressing roller 32. The heating roller 31 is provided with an electric heat generator inside. The pressing roller 32 is provided in such a manner that its peripheral surface faces with that of the heating roller 31. The heating roller 31 is drivenly rotated in a clockwise direction about a roller shaft. The pressing roller 32 is drivenly rotated in a counter-clockwise direction about a roller shaft. Then, after the transferring processing, a sheet P passes through a nip portion between the heating roller 31 and the pressing roller 32. Accordingly, the sheet P obtains heat from the heating roller 31, and the fixing processing is performed. After the fixing processing is performed, the sheet P is discharged to the sheet discharging portion 40 by the sheet conveying passage 50.

The sheet discharging portion 40 is adapted to discharge a sheet P to which the fixing processing is performed by the fixing device 30, and stores the discharged sheet P. The sheet discharging portion 40 is formed by concavely depressing the top portion of the apparatus main body 1. On the bottom portion of the concavely depressed portion, a sheet discharging tray 41 is formed.

The sheet conveying passage 50, in accordance with a control of the controller 60, conveys a sheet P fed from the sheet storing portion 10 to the sheet discharging portion 40 via the image forming portion 20 and the fixing device 30.

Figure 2:
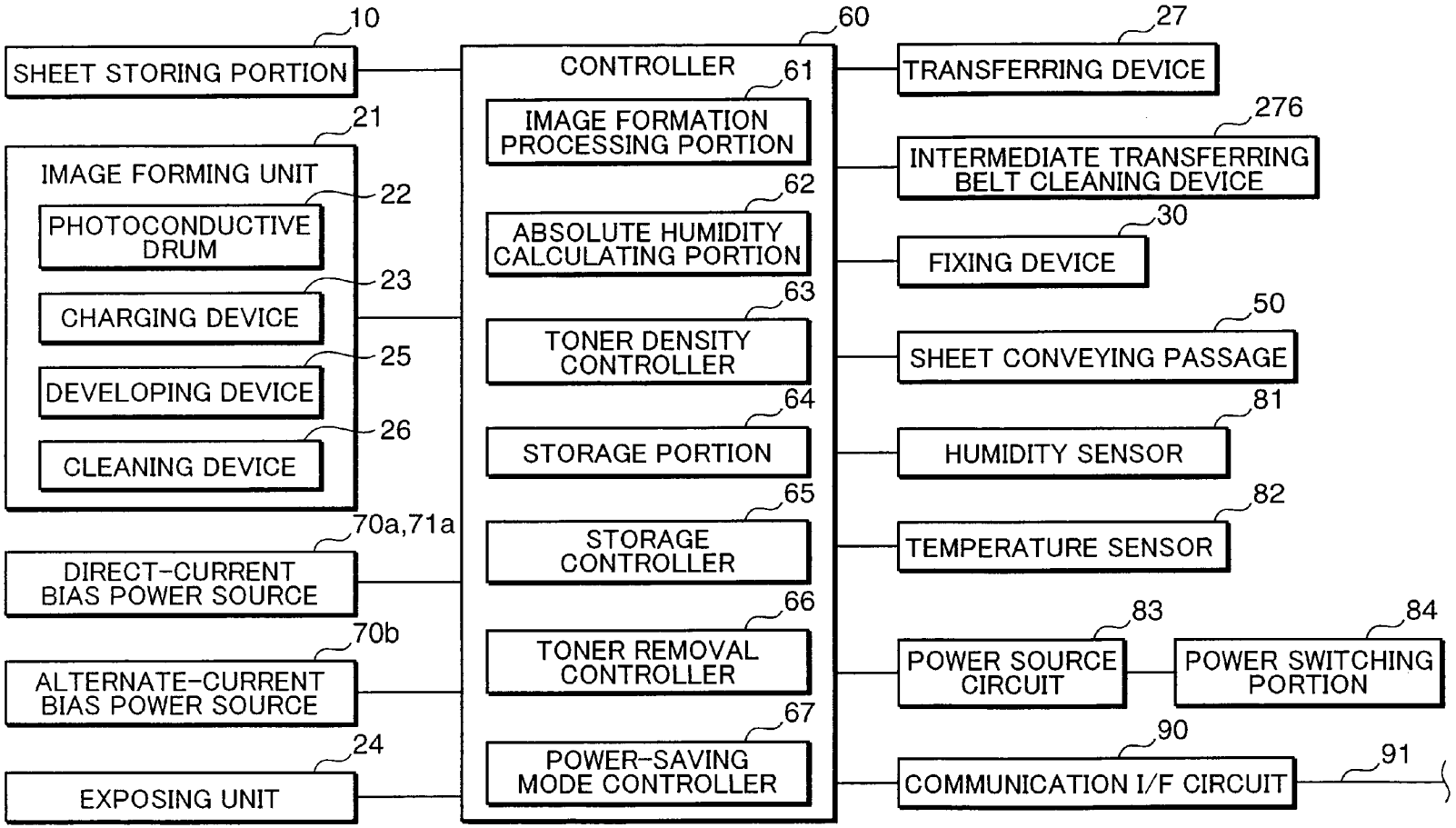
FIG. 2 is a block diagram showing an example of an electric configuration of the color printer apparatus shown in FIG. 1.

FIG. 2 is a block diagram showing an example of an electric configuration of the color printer apparatus CP. A humidity sensor 81 is, for example, provided near the image forming portion 20, and it detects a relative humidity and outputs the detection data to the controller 60. A temperature sensor 82 is, for example, provided near the humidity sensor 81, and it detects a temperature and outputs the detection data to the controller 60.

A power source circuit 83 supplies an electric power for operation to respective portions of the color printer apparatus CP based on a commercial alternating-current electric power supplied from outside. A power switching portion 84 is a switch adapted to turn on and off a power source of the apparatus. When the power switching portion 84 is turned on, an electric power for operation is supplied from the power source circuit 83 to the respective portions, and then the color printer apparatus is booted up. Further, when the power switching portion 84 is turned off, a supply of electric power for operation from the power source circuit 83 to the respective portions is suspended. Accordingly, the color printer apparatus CP suspends its operation.

A communication I/F circuit 90 is an interface circuit connected to an external appliance such as a computer via LAN (Local Area Network) or the like for transmitting or receiving various kinds of signals to or from an external appliance. For example, a network interface (10/100Base-TX) is used.

The controller 60 is connected to the sheet storing portion 10, the image forming portion 20, the fixing device 30, the sheet conveying passage 50, direct-current bias power sources 70*a*, 71*a*, an alternate-current bias power source 70*b*, the humidity sensor 81, the temperature sensor 82, the power source circuit 83, the communication I/F circuit 90 and the like. The controller 60 performs controls over these in accordance with the functions, and thereby controlling the respective portions of the color printer apparatus CP. For example, the controller 60 includes a CPU (Central Processing Unit), a ROM (Read Only Memory) storing in advance various programs executed by the CPU and data or the like necessary for the execution, a RAM (Random Access Memory) as so called a working memory of the CPU, a storage portion 64 including a nonvolatile memory such as an EEPROM (Electrically Erasable and Programmable Read Only Memory) and a RAM backed up by a battery, peripheral circuits and the like. The controller 60 executes a program stored in the ROM to function as an image formation processing portion 61, an absolute humidity calculating portion 62, a toner density controller 63, a storage controller 65, a toner removal controller 66 and a power-saving mode controller 67.

The image formation processing portion 61 performs control for an image formation processing in the color printer apparatus CP. The absolute humidity calculating portion 62 calculates an absolute humidity based on a relative humidity detected by the humidity sensor 81 and a temperature detected by the temperature sensor 82. The absolute humidity calculating portion 62 calculates an absolute humidity by referring to a LUT (Look Up Table) stored in the ROM showing a relationship between a relative humidity and a temperature and an absolute humidity. In this case, the absolute humidity calculating portion 62, the humidity sensor 81 and the temperature sensor 82 correspond to an example of the humidity detector.

The toner density controller 63 decreases the toner density in the developing device 25 in accordance with increase in an absolute humidity calculated by the absolute humidity calculating portion 62, and increases the toner density in the developing device 25 in accordance with decrease in an absolute humidity calculated by the absolute humidity calculating portion 62 to thereby adjust changes in the image density due to an effect of the changes in humidity. The storage controller 65 controls the storage portion 64 to store an absolute humidity calculated by the absolute humidity calculating portion 62.

The toner removal controller 66 controls the cleaning device 26 to remove toner particles remained in the developing device 25 if a difference between an absolute humidity calculated by the absolute humidity calculating portion 62 when the power switching portion 84 is turned on and an absolute humidity stored in the storage portion is more than a predetermined difference value.

The power-saving mode controller 67 changes an operation mode to a sleep mode (power-saving mode) for reducing consumption of electric power when, for example, an unillustrated power-saving switch is pressed down by a user, or when an image forming is not performed for more than a predetermined period of time. In the sleep mode, a supply of electric power to a portion consuming large amount of electric power from the power source circuit 83 e.g. a heat-generating body in the heating roller 31 is suspended in accordance with a control signal from the power-saving mode controller 67. Accordingly, consumption of electric power is reduced.

Figure 3:
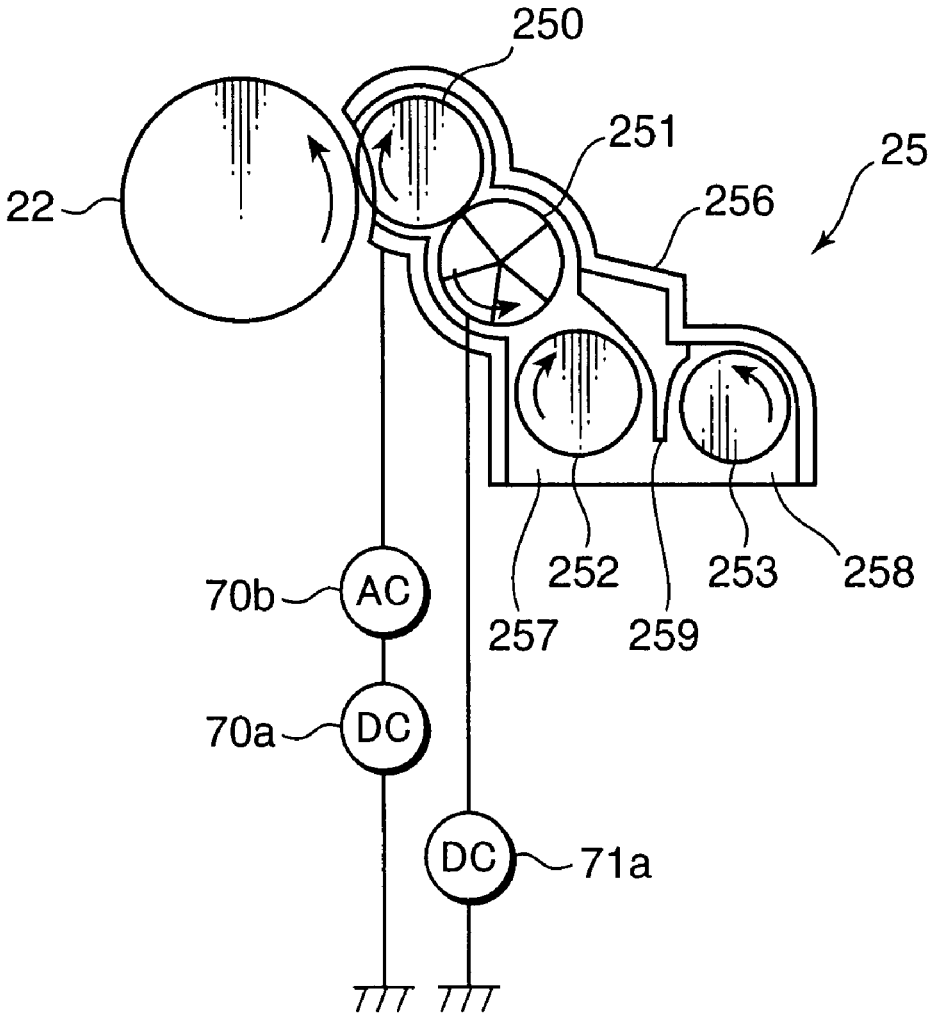
FIG. 3 is a drawing schematically showing an example of a configuration of the photoconductive drum and the developing device shown in FIG. 1.

Next, the developing device 25 will be further described. FIG. 3 is a drawing schematically showing an example of a configuration of the photoconductive drum 22 and the developing device 25 shown in FIG. 1. The developing device 25 includes a developing roll 250, a magnetic roll 251 as a developer conveying body, a paddle mixer 252, a stirring mixer 253 and a housing 256. The developing roll 250 bears a thin toner layer and develops an electrostatic latent image formed on the photoconductive drum 22. The magnetic roll 251 generates a magnetic brush of two-component developer particles by a magnet provided therein, and supplies toner particles to the developing roll 250. The paddle mixer 252 and the stirring mixer 253, each having spiral blades, stir developer particles while conveying the same in opposite directions from each other, charge toner particles with electricity and convey the same to the magnetic roll 251. The housing 256 is a main body portion of the developing device 25.

The housing 256 is formed with a first developer stirring chamber 257 and a second developer stirring chamber 258 inside. Further, the developing device 25 is connected with a direct-current bias power source 70*a* for applying a direct-current (DC) bias to the developing roll 250, an alternate-current bias power source 70*b* for applying an alternate-current (AC) bias to the developing roll 250 and a direct-current bias power source 71*a* for applying a direct-current (DC) bias to the magnetic roll 251. For example, at the time of a developing processing, an output voltage of the direct-current bias power source 70*a* is set to be 100V; an output voltage of the alternate-current bias power source 70*b* is set to be 1.5 kV, 3.5 kHz; and an output voltage of the direct-current bias power source 71*a* is set to be 400V.

The developer has roles of supplying and collecting toner particles. For example, carrier particles having 106 Ωcm to 109 Ωcm of volume resistivities are used. The developer removes toner particles being strongly and electrostatically adhered to the developing roll 250 with a magnetic brush bore on the magnetic roll 251 at a nip portion between the developing roll 250 and magnetic roll 251, and supplies toner particles necessary for a developing processing. As carrier particles having high magneticity and low resistance, a magnetite carrier, a Mn ferrite, a Mn—Mg ferrite or the like can be used. A blend ratio of toner particles and carrier particles of the developer should be 2 to 20 volume percent with respect to the total amount. More preferably, it should be 5 to 15 volume percent.

In the developing device 25 configured as described above, if the blend ratio of toner particles in the developer i.e. the toner density is low, a charge amount of toner particles is increased so that toner particles become hardly separated from carrier particles. Consequently, an image density is decreased. On the other hand, if the toner density is high, the charge amount of toner particles is decreased so that toner particles become easily separated from carrier particles. Consequently, the image density is increased. Further, an absolute humidity in the developing device 25, in other words, the amount of water vapor in a unit volume of atmosphere is decreased, the charge amount of toner particles is raised so that toner particles become hardly separated from carrier particles. Consequently, the image density is decreased. On the other hand, if the absolute humidity is increased, the charge amount of toner particles is decreased so that toner particles become easily separated from carrier particles. Consequently, the image density is increased, toner particles fly out of the developing device 25 and soil inside image forming apparatus, or spattering of toner particles may be caused on an image.

An image forming operation of the color printer apparatus CP having such configuration will be described. First, after the charging device 23 charges the photoconductive drum 22, an exposing is performed by the exposing unit 24. Accordingly, an electrostatic latent image is formed on the peripheral surface of the photoconductive drum 22. The electrostatic latent image is developed to be a toner image by the developing device 25. The toner image formed on the peripheral surface of the photoconductive drum 22 is transferred to the intermediate transferring belt 271 by a transfer bias applied to the primary transferring roller 272. Then, toner particles which are not transferred to the intermediate transferring belt 271 but remained on the photoconductive drum 22 are cleaned by the cleaning device 26 and stored into an unillustrated collection bottle. Such exposing, developing and transferring operations are performed consecutively for respective developing colors of yellow, magenta, cyan and black. On the surface of the intermediate transferring belt 271, toner images of respective colors are superimposed. Accordingly, a full-color toner image is formed on the intermediate transferring belt 271.

After a full-color toner image is formed on the intermediate transferring belt 271, the secondary transferring roller 275 comes in contact with the intermediate transferring belt 271. Then, a sheet P is conveyed sheet conveying passage 50 from the sheet storing portion 10 to a transferring position at an appropriate timing. Next, at the transferring position, the full-color toner image formed on the intermediate transferring belt 271 by a secondary transfer bias applied to the secondary transferring roller 275 is transferred to the sheet P. Then, the full-color toner image transferred to the sheet P is fixed on the sheet P by heating and pressing by the fixing device 30. The sheet P on which the toner image is fixed is discharged to the sheet discharging portion 40. Toner particles remained on the intermediate transferring belt 271 are cleaned by making the intermediate transferring belt cleaning device 276 of the intermediate transferring belt 271 come in contact with the intermediate transferring belt 271 after the secondary transfer and collected into an unillustrated collection bottle.

During such image forming operation, the developing device 25 is operated as follows in view of supply of toner particles. First, the absolute humidity calculating portion 62 calculates an absolute humidity based on a relative humidity detected by the humidity sensor 81 and a temperature detected by the temperature sensor 82. Then, changes in the image density due to changes in humidity is adjusted where a charge amount of toner particles is reduced so that an image density is increased when the absolute humidity is increased, and on the other hand, the charge amount of toner particles is increased so that an image density is decreased when an absolute humidity is decreased.

The toner density controller 63 refers to an LUT stored for example in the ROM showing a relationship between the absolute humidity and the toner density and calculates the toner density corresponding to the calculated absolute humidity. Then, the toner density controller 63 adjusts the amount of supplied toner particles in such a manner that the toner density in the developing device 25 becomes equal to the calculated toner density. In other words, when the absolute humidity calculated by the calculating portion 62 is increased, the toner density controller 63 reduces amount of toner particles supplied from an unillustrated toner container to the developing device 25 to thereby lower the toner density. Consequently, increase in the image density due to the increase in humidity is reduced. On the other hand, when the absolute humidity calculated by the absolute humidity calculating portion 62 is decreased, the toner density controller 63 increases an amount of toner particles to be supplied from an unillustrated toner container to the developing device 25 to thereby increases the toner density. Consequently, the decrease in the image density due to the increase in humidity is reduced.

As described above, the toner density in the two-component developer consisting of toner particles and carrier particles corresponding to respective developing colors such as yellow, cyan, magenta and black is decreased in accordance with increase in the absolute humidity, and is increased in accordance with decrease in the absolute humidity, by the toner density controller 63. The two-component developer is mixed and charged by the stirring mixer 253 and the paddle mixer 252 shown in FIG. 3 and supplied to the magnetic roll 251. Then, a magnetic brush is formed on the magnetic roll 251, and a thin layer consisting of toner particles is formed on the developing roll 250 by the difference of electric potential between e.g. +400V applied to the magnetic roll 251 by the direct-current bias power source 71*a* and e.g. +100V applied to the developing roll 250 by the direct-current bias power source 70*a*. A thickness of the toner thin layer formed on the developing roll 250 is changed according to a resistance of the developer or the difference in rotational speed between the developing roll 250 and the magnetic roll 251, but the thickness can be controlled by the above-mentioned difference in electric potential. When the difference of electric potential is made larger, the layer of toner particles on the developing roll 250 becomes thicker. When the difference is made smaller, the layer becomes thinner.

Then, in accordance with a control signal from the image formation processing portion 61, at first, the photoconductive drum 22 is charged by the charging device 23 to be e.g. 400V. Thereafter, the exposing unit 24 performs exposing. Accordingly, an electric potential of the exposed photoconductive drum 22 becomes about 70V, and an electrostatic latent image is formed. The electrostatic latent image is developed by toner particles which flies from the toner thin layer on the developing roll 250 to the photoconductive drum 22 by e.g. +100V applied to the developing roll 250 by the direct-current bias power source 70*a*, Vp-p1.6 kV superimposed by the alternate-current bias power source 70*b* and a rectangular wave having a frequency of 3.0 kHz, a duty ratio of 30%. Accordingly, a toner image is formed. To prevent spattering of toner particles, an alternate-current voltage is applied by the alternate-current bias power source 70*b* immediately before the developing.

When a toner image is formed on the photoconductive drum 22 and developed, and the toner density of the developer in the developing device 25 is lowered due to the developing, a necessary amount of toner particles are supplied from an unillustrated toner container to the developing device 25 in accordance with a control signal from the toner density controller 63. Accordingly, the toner density in the developing device 25 is set to be an appropriate density according to the absolute humidity and adjusted so as to obtain an appropriate image density.

Figure 4:
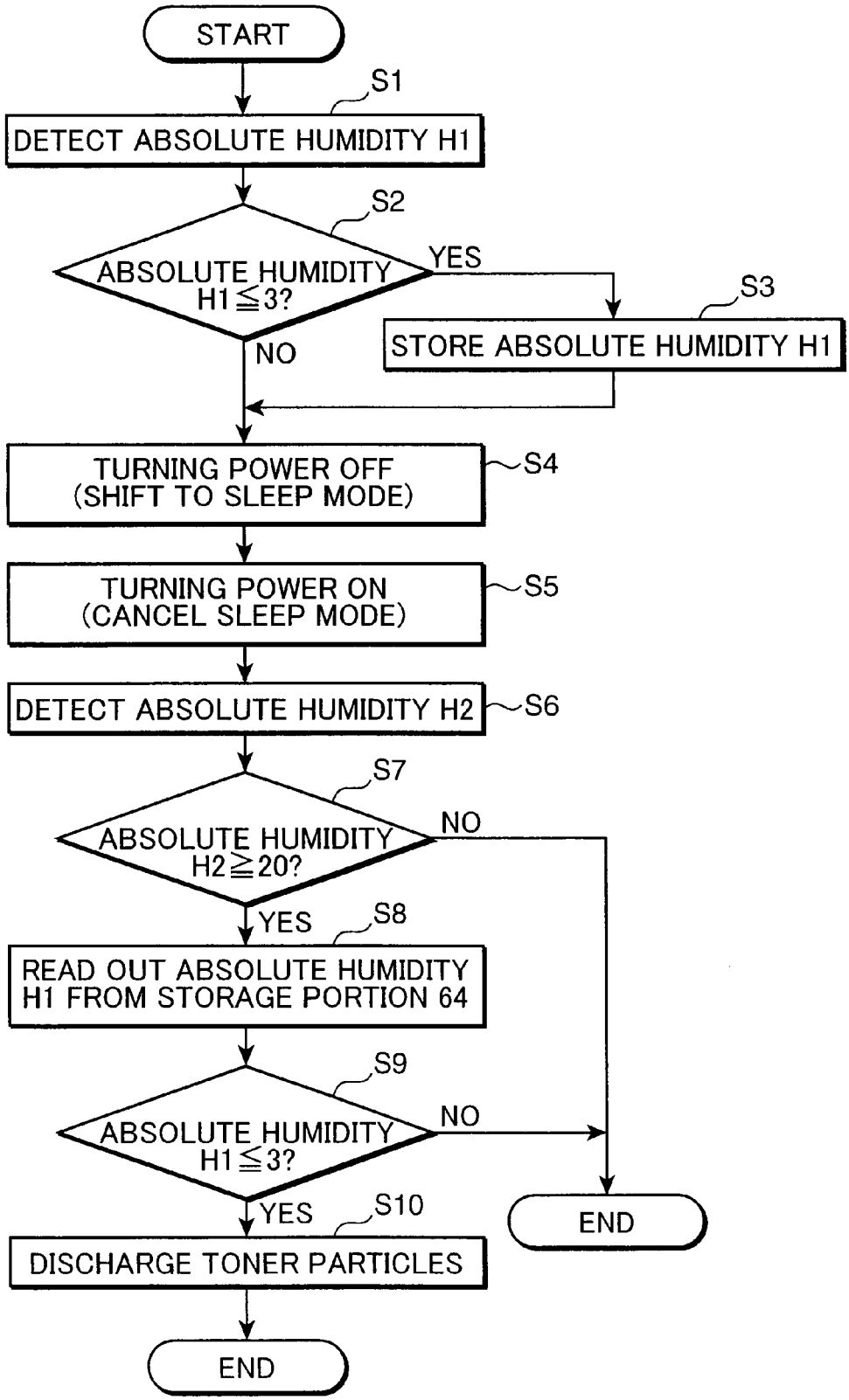
FIG. 4 is a flowchart showing an example of an operation of the color printer apparatus shown in FIG. 2 in a toner removing processing.

Next, operations of the storage controller 65 and the toner removal controller 66 shown in FIG. 2 will be described. FIG. 4 is a flowchart showing an example of an operation of the color printer apparatus shown in FIG. 2 in a toner removing processing. First, the absolute humidity calculating portion 62 calculates an absolute humidity H1 based on a relative humidity detected by the humidity sensor 81 and a temperature detected by the temperature sensor 82 (Step S1). In this case, as described above, the toner density controller 63 adjusts the toner density in the developing device 25 in accordance with the absolute humidity H1 such that the image density becomes appropriate.

Next, the storage controller 65 compares the absolute humidity H1 calculated by the absolute humidity calculating portion 62 with a first absolute humidity showing a predetermined low humidity e.g. 3 ($g/m^3$). In other words, the storage controller 65 determines whether or not the absolute humidity H1 is equal to or lower than the first absolute humidity (Step S2). Here, when it is determined that the absolute humidity H1 is equal to or lower than 3 ($g/m^3$) (YES in Step S2), the storage controller 65 stores the absolute humidity H1 in the storage portion 64 (Step S3), and the routine goes to the processing in Step S4. On the other hand, when it is determined that the absolute humidity H1 is higher than 3 (g/m$^3$) (NO in Step S2), the storage controller 65 does not store the absolute humidity H1 in the storage portion 64, and the routine goes to the processing in Step S4. It may be so configured that the storage controller 65 periodically, e.g. every 5 minutes, stores the absolute humidity H1 in the storage portion 64 regardless of a value of the absolute humidity H1.

Next, in Step S4, when the power switching portion 84 is turned off and a supply of electric power for operation from the power source circuit 83 to the respective portions of the color printer apparatus CP is suspended, or when an operation mode is shifted to the sleep mode by the power-saving mode controller 67, the storage controller 65 does not perform an operation of newly storing the absolute humidity H1 to the storage portion 64, and the absolute humidity stored in the storage portion 64 is maintained. Further, in Step S2, if the absolute humidity is equal to or lower than 3 (g/m$^3$), the toner density of the toner particles remained in the developing device 25 is set to be a high density by toner density controller 63 in accordance with the absolute humidity H1 showing a low humidity state of lower than the first absolute humidity.

Then, in Step S5, when the power switching portion 84 is turned on and a supply of electric power for operation from the power source circuit 83 to the respective portions in the color printer apparatus CP is started, or when, for example, image data from a personal computer connected with the communication I/F circuit 90 via the LAN 91 is received and the power-saving mode controller 67 releases the sleep mode and shifts an operation mode to a normal mode, the absolute humidity calculating portion 62 calculates again an absolute humidity H2 based on a relative humidity detected by the humidity sensor 81 and a temperature detected by the temperature sensor 82 (Step S6).

Next, the toner removal controller 66 compares the absolute humidity H2 calculated by the absolute humidity calculating portion 62 with a second absolute humidity showing a predetermined high humidity e.g. 20 (g/m$^3$). In other words, the toner removal controller 66 determines whether or not the absolute humidity H2 is equal to or more than the second absolute humidity (step S7). Here, when it is determined that the absolute humidity H2 is lower than 20 (g/m$^3$) (NO in Step S7), the processing is terminated.

On the other hand, when the absolute humidity H2 is equal to or more than 20 (g/m$^3$) (YES in Step S7), the toner removal controller 66 reads out the absolute humidity H1 from the storage portion 64 and compares with the first absolute humidity i.e. 3 (g/m$^3$). In other words, the toner removal controller 66 determines whether or not the absolute humidity H1 is equal to or lower than the first absolute humidity (Step S8). Then, when it is determined that the absolute humidity H1 is higher than 3 (g/m$^3$) (NO in Step S9), the processing is terminated. On the other hand, when it is determined that the absolute humidity H1 is equal to or lower than 3 (g/m$^3$) (YES in Step S9), the processing goes to Step S10 to dispose toner particles remained in the developing device 25.

The second absolute humidity is set to be a predetermined difference value of 17 (g/m$^3$) higher with respect to the first absolute humidity. In the processings in Steps S6 to S9, when the absolute humidity H2 at the time when the power source is turned on again or shifted to the normal mode becomes 17 (g/m$^3$) higher or more than the absolute humidity H1 in a state before the power source is turned off or shifted to the sleep mode, the routine goes to Step S10.

In this state, in Step S10, since toner particles having a high density in accordance with the absolute humidity H1 in a low humidity state of more than 17 (g/m$^3$) lower than the present state remains in the developing device 25, the image density becomes too high if an image forming is performed under a high humidity state where the absolute humidity H2 is more than the second absolute humidity.

Accordingly, in Step S10, the image forming is performed after the high-density toner particles remaining in the developing device 25 are disposed. Accordingly, the image density does not become too high, and the degrading of an image quality can be reduced. In this case, the first absolute humidity, the second absolute humidity and the difference value may be properly set after experimentally finding out humidity conditions which causes lowering of image quality before and after the change in humidity.

In Steps S7 to S9, the toner removal controller 66 is not limited to the example that the routine goes to Step S10 when the absolute humidity H1 does not reach the predetermined first absolute humidity and the absolute humidity H2 being more than the second absolute humidity. It may be so configured that the routine goes to Step S10 when the difference between the absolute humidity H2 and the first absolute humidity is more than the difference value.

Next, in Step S10, in response to a control signal from the toner removal controller 66, the developing device 25 allows toner particles of an amount which can be collected by the cleaning device 26 per unit of time to adhere to the photoconductive drum 22 and disposes the same. Then, the cleaning device 26 removes toner particles adhered to the photoconductive drum 22 and disposes the same. In this case, since the high density toner particles remaining in the developing device 25 are disposed, the high density toner particles cause the image density to be high. Accordingly, lowering of an image quality can be reduced. Further, the developing device 25 disposes toner particles of an amount which can be removed by the cleaning device 26 per unit of time. Accordingly, it can be suppressed that toner particles are not completely removed by the cleaning device 26 and spill out.

The toner removal controller 66 may control, for example, the developing device 25 to repeatedly form band-like toner images on the photoconductive drum 22 and adjusts size and intervals of the band to adjust the amount of toner to be adhered to the photoconductive drum 22 to be a collectable amount. The amount of toner particles may be adjusted by various image patterns such as a net or a dot pattern. Further, the toner removal controller 66 may control, for example, an electric potential difference between the magnetic roll 251 and the developing roll 250 by controlling an output voltage of the direct-current bias power source 71*a* and an output voltage of the direct-current bias power source 70*a* to adjust a thickness of a toner layer to be adhered to the photoconductive drum 22 and an amount of toner particles to be adhered to the photoconductive drum 22.

Further, since the cleaning device 26 is adapted for removing and cleaning toner particles remaining on the peripheral surface of the photoconductive drum 22 after the transferring processing at the time of forming an image, there usually is no need to remove a large amount of toner particles, and an ability to remove toner particles is set to be small. Therefore, there is a likelihood that a removing time becomes long if it is attempted to remove toner particles remained in the developing device 25 by using the cleaning device 26.

With that, it may be so configured that the toner removal controller 66 controls developing device 25 to allow toner particles of an amount which can be removed by the intermediate transferring belt cleaning device 276 per unit of time adhere to the photoconductive drum 22, controls the primary transferring roller 272 to transfer the toner particles adhered to the photoconductive drum 22 to the intermediate transferring belt 271, and then controls the intermediate transferring belt cleaning device 276 to remove the toner particles transferred to the intermediate transferring belt 271. In this case, since the intermediate transferring belt cleaning device 276 can generally remove larger amount of toner particles per unit of time than cleaning device 26, a time for removing the toner particles remained in the developing device 25 can be shortened.

Further, if it is attempted to increase toner removing amount of the cleaning device 26 to shorten the time for removing the remained toner particles, it is necessary to increase respective toner removing amounts of four cleaning devices 26 of the developing devices 25Y, 25M, 25C, 25K. On the contrary, since there is provided one intermediate transferring belt cleaning device 276, increasing the toner removing amount of the toner removing time intermediate transferring belt cleaning device 276 and collecting the remained toner particles by the intermediate transferring belt cleaning device 276 make it easier to shorten the toner removing time.

The toner removal controller 66, even in the case of collecting the remained toner particles by the intermediate transferring belt cleaning device 276, may control, for example, the developing device 25 to repeatedly form on the photoconductive drum 22 band-like toner images and adjust size and intervals of the band to adjust the amount of toner particles to be adhered to the photoconductive drum 22 to be the amount which can be removed by the intermediate transferring belt cleaning device 276. The amount of toner particles may be adjusted by forming various image patterns such as a net and a dot pattern. Further, the toner removal controller 66 may control, for example, an electric potential difference between the magnetic roll 251 and the developing roll 250 by controlling an output voltage of the direct-current bias power source 71*a* and an output voltage of the direct-current bias power source 70*a* to adjust a thickness of a toner layer to be adhered to the photoconductive drum 22 and an amount of toner particles to be adhered to the photoconductive drum 22.

In the case of adjusting the amount of toner particles to be removed by the intermediate transferring belt cleaning device 276 by forming a band-like toner image, for example, it may be so configured that the developing device 25Y, 25M, 25C, 25K transfers respective bands of color toner images to the intermediate transferring belt 271 alternately.

In the above, an example of the case where the state is changed from a low-humidity state to a high-humidity state is shown. However, it may be applied to the case where a change in humidity over the difference value from a high-humidity state to a low-humidity state occurs.

Hereinafter, an image forming apparatus according to another embodiment will be described. In the image forming apparatus according to another embodiment, toner particles in the developing device are removed when a difference between absolute humidity H2 after the power source is turned on and the absolute humidity H1 before the power source is turned off is more than a predetermined difference value.

Figure 5:
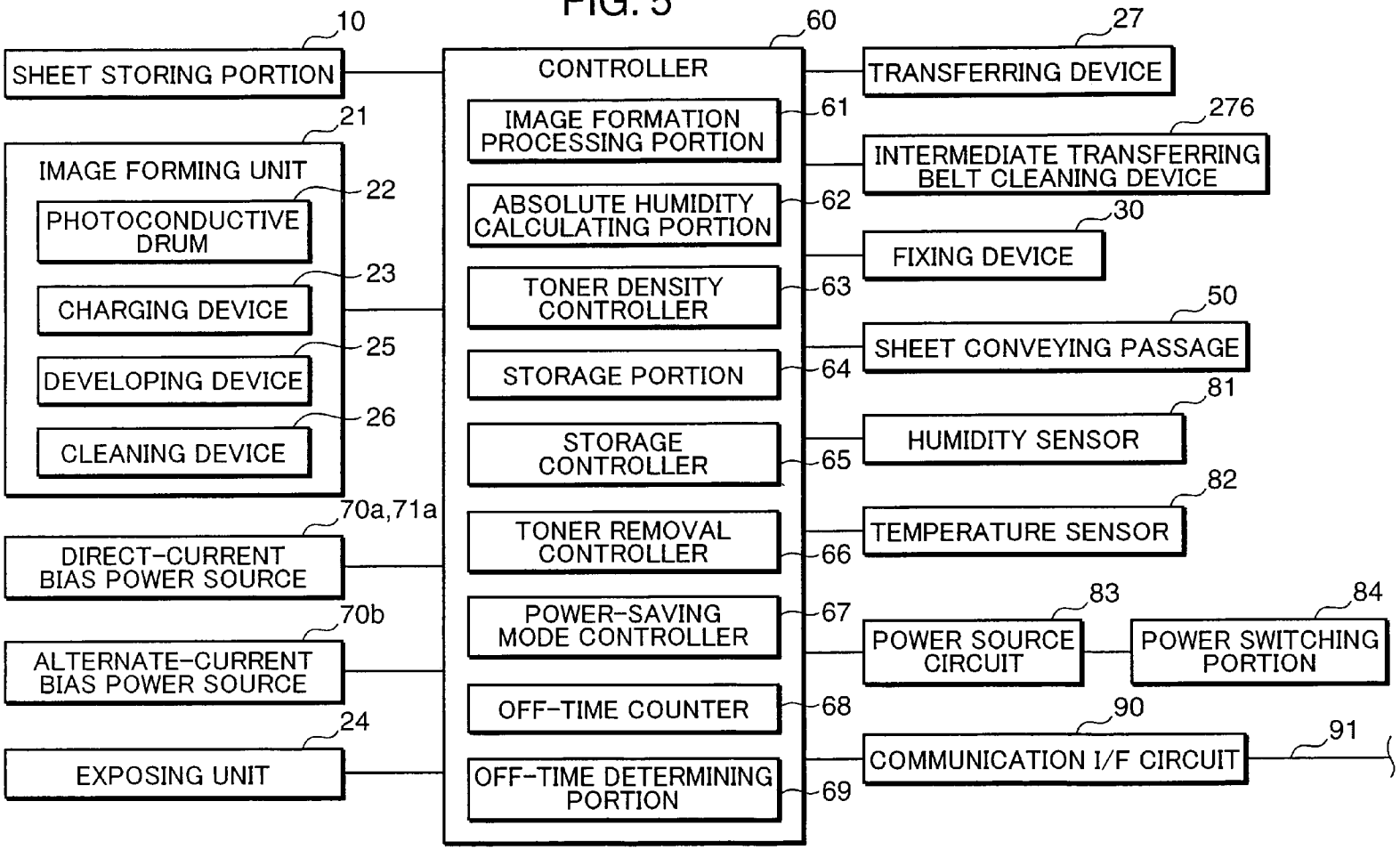
FIG. 5 is a block diagram showing an example of an electric configuration of a color printer apparatus according to another embodiment.

FIG. 5 is a block diagram showing an example of an electric configuration of the color printer apparatus according to another embodiment. In FIG. 5, the components having the same configuration as that of FIG. 2 are provided with the same reference signs, and their descriptions are abbreviated.

The controller 60 shown in FIG. 5 further includes an off-time counter 68 and an off-time determining portion 69. The off-time counter 68 calculates an elapsed time from the turning-off to the turning-on of the power source by the power switching portion 84. More specifically, the off-time counter 68 calculates an elapsed time from the turning-off to the turning-on of the power source by power switching portion 84 based on a time when the power switching portion 84 turned off the power source and a time when the power switching portion 84 turned on the power source. The off-time determining portion 69 determines whether or not the elapsed time counted by the off-time counter 68 is longer than a predetermined time when the power switching portion 84 is turned on.

The toner removal controller 66 determines whether or not the difference between an absolute humidity calculated by the absolute humidity calculating portion 62 and an absolute humidity stored in the storage portion 64 is more than the predetermined difference value only when off-time determining portion 69 determines that the elapsed time is longer than the predetermined time.

Figure 6:
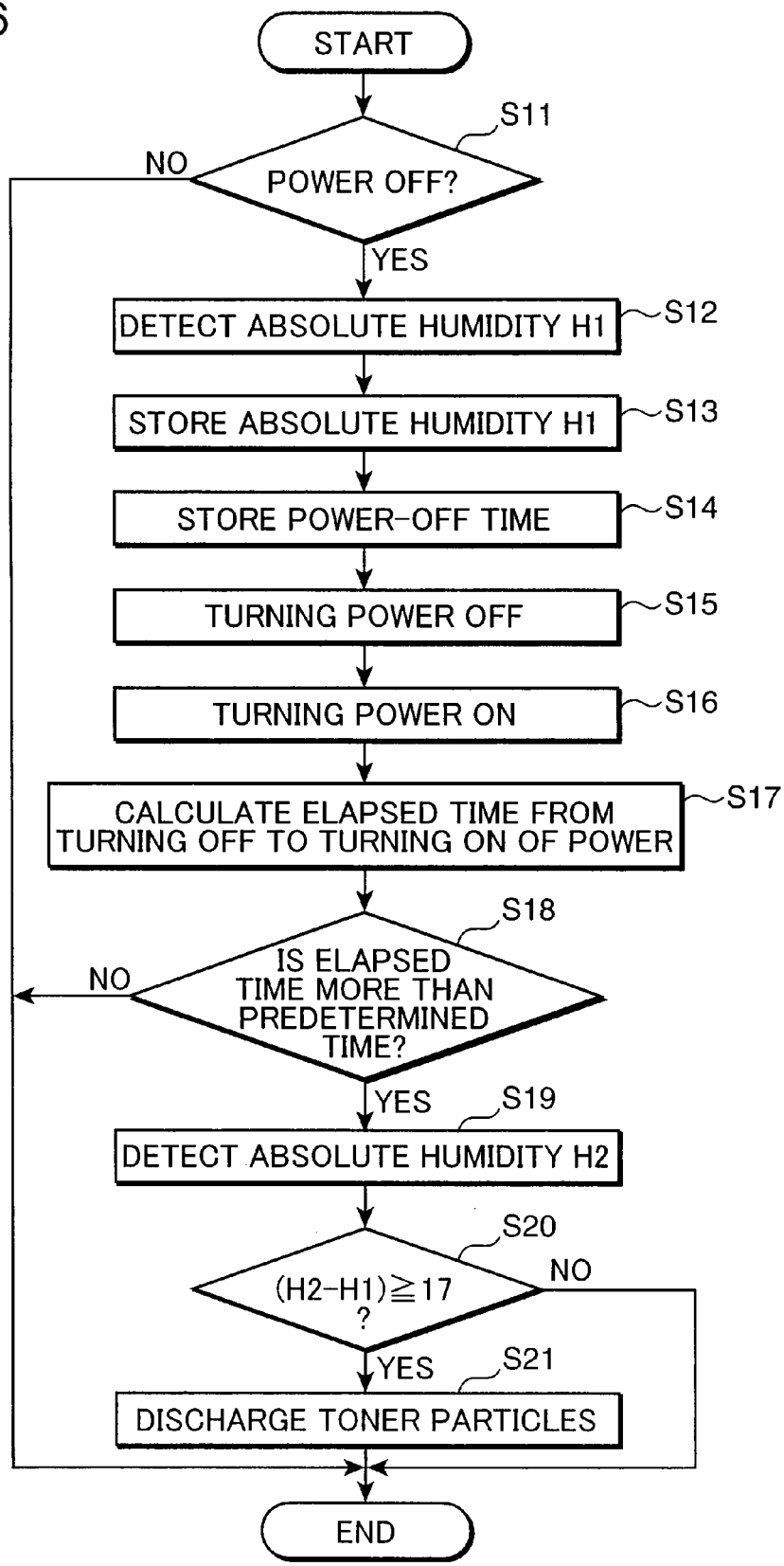
FIG. 6 is a flowchart showing an example of an operation of the color printer apparatus shown in FIG. 5 in a toner removing processing.

Next, an operation of the color printer apparatus shown in FIG. 5 will be described. FIG. 6 is a flowchart showing an example of an operation of the color printer apparatus shown in FIG. 5.

First, the absolute humidity calculating portion 62 determines whether or not the power source is turned off by the power switching portion 84 (Step S11). Further, the absolute humidity calculating portion 62 detects a power source turning-off instruction outputted by the power switching portion 84 to determine whether or not the power source is turned off. When it is determined that the power switching portion 84 is not turned off (NO in Step S11), a toner removing processing is terminated.

On the other hand, when it is determined that power source is turned off by the power switching portion 84 (YES in Step S11), the absolute humidity calculating portion 62 calculates the absolute humidity H1 based on a relative humidity detected by the humidity sensor 81 and a temperature detected by the temperature sensor 82 (Step S12).

Next, the storage controller 65 stores the absolute humidity H1 calculated by the absolute humidity calculating portion 62 in the storage portion 64 (Step S13). Next, the off-time counter 68 stores in the EEPROM the present time as a power-off time at which the power source is turned off (Step S14). Next, the power switching portion 84 turns off the power source (Step S15).

Next, the power switching portion 84 turns on the power source (Step S16). Next, off-time counter 68 calculates an elapsed time from the turning off to the turning on of the power source based on the present time i.e. a power-on time at which the power source is turned on and a power-off time stored at the time when the power source is turned off (Step S17).

Next, the off-time determining portion 69 determines whether or not the elapsed time calculated by the off-time counter 68 is equal to or longer than the predetermined time (Step S18). Usually, an environment where a color printer apparatus is placed does not change rapidly in a short period of time. In other words, a change in humidity is also small when the off-time of the power source is short. Therefore, there is no need to compare an absolute humidity at the time when the power source is turned off and an absolute humidity at the time when the power source is turned on. With that, when it is determined that an elapsed time is shorter than a predetermined time (NO in Step S18), the processing thereafter is terminated. It should be noted that the predetermined time indicates, for example, a time from the turning-off of the power source of the color printer apparatus at night to the turning-on of the power source of the color printer apparatus in the morning of the next day. For example, it is set to be 10 hours.

Further, an operating portion for receiving an operation by a user may be provided so that change of the predetermined time can be received. In this case, the user can change the predetermined time in accordance with his working style or life style.

On the other hand, when it is determined that an elapsed time is equal to or longer than a predetermined time (YES in Step S18), the absolute humidity calculating portion 62 calculates an absolute humidity H2 based on a relative humidity calculated by the humidity sensor 81 and a temperature detected by the temperature sensor 82 (Step S19). Next, the toner removal controller 66 determines whether or not the difference between the absolute humidity H2 and the absolute humidity H1 is equal to or more than the predetermined difference value (Step S20). It should be noted that the predetermined difference value is, for example, 17 $g/m^3$. Here, when it is determined that the difference between the absolute humidity H2 and the absolute humidity H1 is lower than the predetermined difference value (NO in Step S20), the processing is terminated since the change in humidity between the power off-time and the power on-time is not great.

On the other hand, when it is determined that the difference between the absolute humidity H2 and the absolute humidity H1 is equal to or smaller than the predetermined difference value (YES in Step S20), the developing device 25 disposes toner particles of an amount which can be removed per unit of time in accordance with a control signal from the toner removal controller 66 by allowing the toner particles to adhere to the photoconductive drum 22 (Step S21). Then, the cleaning device 26 removes toner particles adhered to the photoconductive drum 22 and disposes the same. Like the case of the other embodiment, the toner particles in the developing device 25 may be collected by using the intermediate transferring belt cleaning device 276.

In the present embodiment, the off-time counter 68 calculates an elapsed time from the turning-off of the power source to the turning-on of the power source. However, the present invention is not limited to this but may calculate an elapsed time from the switching to the power-saving mode to the switching to the normal mode.

The embodiment described above includes the invention having the following configurations.

An image forming apparatus according to one aspect of the present invention comprises: a developing device storing developer particles including toner particles; a developing portion provided with a photoconductive drum for forming a toner image by allowing charged toner particles from the developing device to adhere onto an electrostatic latent image formed on the photoconductive drum; a humidity detector for detecting an absolute humidity; a toner density controller for changing the toner density in the developing device in accordance with a difference between absolute humidities detected by the humidity detector; a storage portion; a storage controller for controlling the storing of an absolute humidity detected by the humidity detector to the storage portion; a power switching portion for turning on and off a power source of the apparatus; and a toner removal controller for controlling the removing of residual toner particles from the developing device if a difference between an absolute humidity detected by the humidity detector when the power source is turned on and an absolute humidity stored in the storage portion is more than a predetermined difference value.

An image forming method according to another aspect of the present invention comprises: a first humidity detecting step of detecting an absolute humidity; a toner intensity controlling step of changing, in accordance with a change in the absolute humidity detected in the first humidity detecting step, the toner density of a developing device for storing developer particles including toner particles; a storage controlling step of storing in a storage portion an absolute humidity detected in the first humidity detecting step; a power turning-off step of turning off a power source; a power turning-on step of turning on the power source; a second humidity detecting step of detecting an absolute humidity when the power source is turned on in the power turning-on step; and a toner removing step of removing residual toner particles from the developing device when a difference between an absolute humidity detected in the second humidity detecting step and an absolute humidity stored in the storage portion is more than a predetermined difference value.

According to the aforementioned configurations, an image forming is performed by allowing charged toner particles to be adhered onto an electrostatic latent image formed on the photoconductive drum to thereby form a toner image, and transferring the toner image to a recording sheet. Further, the toner density in the developing device for storing developer particles including toner particles is changed in accordance with a change in an absolute humidity. Accordingly, an effect of the change in humidity with respect to the image density is reduced. Then, an absolute humidity detected by the humidity detecting step is stored in the storage portion. Further, if a difference between an absolute humidity detected by the humidity detecting step and an absolute humidity stored in the storage portion is more than a predetermined difference value when the power source is turned on, toner particles remained in the developing device are removed.

Accordingly, the toner removing device removes from the developing device for storing developer particles including toner particles toner particles whose toner density is adjusted in accordance with a condition of the absolute humidity being different from the present condition before the power source is turned off. Consequently, degradation of an image quality which occurs when a humidity at the time of turning off the power source and a humidity at the time of turning on the power source has a difference can be reduced.

Further, in the above-described image forming apparatus, it is preferable that the storage controller controls the storage portion to store an absolute humidity detected by the humidity detector when the power source is turned off by the power switching portion.

According to this configuration, when the power source is turned off by the power switching portion, an absolute humidity detected by the humidity detector is stored in the storage portion. Accordingly, an absolute humidity at the time when the power source is turned off and an absolute humidity at the time when the power source is turned on can be compared.

Further, in the above-described image forming apparatus, it is preferable that the toner removal controller further controls the removing of residual toner particles from the developing device if a difference between an absolute humidity detected by the humidity detector when a power-saving mode of reducing power consumption during a suspension of image forming is shifted to a normal mode during operation of image forming and an absolute humidity stored in the storage portion is more than the predetermined difference value.

According to this configuration, the toner removal controller removes toner particles remained in the developing device if a difference between an absolute humidity detected by the humidity detector when a power-saving mode is shifted to a normal mode and an absolute humidity stored in the storage portion is more than the predetermined difference value. Accordingly, toner particles whose toner density is adjusted in accordance with a condition of absolute humidity before being shifted to the power-saving mode are collected from the developing device. Accordingly, the lowering of image quality when the humidities are different between the power-saving mode and the normal mode can be reduced.

Further, in the above-described image forming apparatus, it is preferable that the toner removal controller determines that the difference is more than the predetermined difference value, when an absolute humidity stored in the storage portion is less than a predetermined first absolute humidity, and an absolute humidity detected by the humidity detector is more than a second absolute humidity the predetermined difference value higher than the first absolute humidity.

According to this configuration, when the present absolute humidity becomes more than the predetermined difference value higher than an absolute humidity stored in the storage portion, and the absolute humidity stored in the storage portion does not reach the first absolute humidity and the present absolute humidity becomes higher than the second absolute humidity, toner particles remained in the developing device are collected. Accordingly, conditions of the absolute humidity at which toner particles remained in the developing device are collected can be set in detail.

Further, it is preferable that the above-described image forming apparatus further comprises a toner removing device for collecting toner particles adhered to the photoconductive drum, and that the toner removal controller controls the developing portion to allow toner particles of a collectable amount from the developing device to adhere to the photoconductive drum and controls the toner removing device to collect the toner particles adhered to the photoconductive drum.

According to this configuration, toner particles remained in the developing device are allowed to adhere to the photoconductive drum and removed by the toner removing device. Then, an amount of the toner particles allowed to adhere to the photoconductive drum by the developing portion is set to be the amount which can be collected by the toner removing device. Accordingly, it is reduced that toner particles cannot be fully removed by the toner removing device.

Further, it may be so configured that the above-described image forming apparatus comprises: a transferring device provided with a transferring belt coming close to the photoconductive drum and moving in a predetermined direction, the transferring device being adapted for transferring a toner image formed on the photoconductive drum to the transferring belt and transferring the toner image transferred to the transferring belt to the recording sheet; and a toner removing device for removing toner particles adhered to the transferring belt. The toner removal controller controls the developing portion to allow toner particles of a collectable amount from the developing device to adhere to the photoconductive drum and controls the transferring device to allow toner particles to be adhered to the transferring belt and controls the toner removing device to remove the toner particles adhered to the transferring belt.

According to this configuration, toner particles remained in the developing device are allowed to adhere to the photoconductive drum and transferred from the photoconductive drum to the transferring belt. Then, the toner particles are removed from the transferring belt by the toner removing device. Since the amount of toner particles allowed to adhere to the photoconductive drum by the developing portion transferring belt is set to be an amount which can be removed by the toner removing device, it can be reduced that the toner particles are not fully removed by the toner removing device.

Further, it is preferable that the above-described image forming apparatus comprises: an off-time counter for counting an elapsed time from the turning-off to the turning-on of the power source by the power switching portion; and a time determining portion for determining whether or not the elapsed time counted by the off-time counter is longer than a predetermined time when the power source is turned on. The toner removal controller determines whether or not the difference between an absolute humidity detected by the humidity detector and an absolute humidity stored in the storage portion is more than the predetermined difference value only when the time determining portion determines that the elapsed time is longer than the predetermined time.

According to this configuration, an elapsed time from the turning-off to the turning-on of the power source by the power switching portion is counted. Then, when power switching portion is turned on, it is determined whether or not the counted elapsed time is longer than the predetermined time. Here, only when it is determined that the elapsed time is longer than the predetermined time, whether or not the difference between an absolute humidity detected by the humidity detector and an absolute humidity stored in the storage portion is more than the predetermined difference value is determined.

Usually, an environment where the image forming apparatus is placed does not change rapidly in a short period of time. In other words, a change in humidity is also small when the off-time of the power source is short. Therefore, there is no need to compare an absolute humidity at the time when the power source is turned off and an absolute humidity at the time when the power source is turned on. Thus, when an elapsed time is shorter than the predetermined time, whether or not the difference between an absolute humidity at the time when the power source is turned on and an absolute humidity at the time when the power source is turned off is over the predetermined difference value is not determined. Consequently, a processing time can be shortened.

This application is based on Japanese Patent application serial no. 2006-126804 filed in Japan Patent Office on Apr. 28, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a developing device storing developer particles including toner particles;

a developing portion provided with a photoconductive drum for forming a toner image by allowing charged toner particles from the developing device to adhere onto an electrostatic latent image formed on the photoconductive drum;

a humidity detector for detecting an absolute humidity;

a toner density controller for changing the toner density in the developing device in accordance with the absolute humidity detected by the humidity detector;

a storage portion;

a power switching portion for turning on and off a power source of the apparatus;

a storage controller for controlling the storing of an absolute humidity detected by the humidity detector to the storage portion, the storage controller controlling the storage portion to maintain the absolute humidity detected by the humidity detector when the power source is turned off by the power switching portion; and a toner removal controller for controlling the removing of residual toner particles from the developing device if a difference between an absolute humidity in a power-on state detected by the humidity detector and an absolute humidity in a power-off state stored in the storage portion is more than a predetermined difference value when the power source is turned on by the power switching portion.

2. The image forming apparatus according to claim 1, wherein the toner removal controller further controls the removing of residual toner particles from the developing device if a difference between an absolute humidity detected by the humidity detector when a power-saving mode of reducing power consumption during a suspension of image forming is shifted to a normal mode during operation of image forming and an absolute humidity stored in the storage portion is more than the predetermined difference value.

3. The image forming apparatus according to claim 1, wherein the toner removal controller determines that the difference is more than the predetermined difference value, when an absolute humidity stored in the storage portion is less than a predetermined first absolute humidity, and an absolute humidity detected by the humidity detector is more than a second absolute humidity the predetermined difference value higher than the first absolute humidity.

4. The image forming apparatus according to claim 1, further comprising a toner removing device for collecting toner particles adhered to the photoconductive drum, wherein the toner removal controller controls the developing portion to allow toner particles of a collectable amount from the developing device to adhere to the photoconductive drum and controls the toner removing device to collect the toner particles adhered to the photoconductive drum.

5. The image forming apparatus according to claim 1, further comprising: a transferring device provided with a transferring belt coming close to the photoconductive drum and moving in a predetermined direction, the transferring device being adapted for transferring a toner image formed on the photoconductive drum to the transferring belt and transferring the toner image transferred to the transferring belt to the recording sheet; and a toner removing device for removing toner particles adhered to the transferring belt, wherein the toner removal controller controls the developing portion to allow toner particles of a collectable amount from the developing device to adhere to the photoconductive drum and controls the transferring device to allow toner particles to be adhered to the transferring belt and controls the toner removing device to remove the toner particles adhered to the transferring belt.

6. The image forming apparatus according to claim 1, further comprising:

an off-time counter for counting an elapsed time from the turning-off to the turning-on of the power source by the power switching portion; and a time determining portion for determining whether or not the elapsed time counted by the off-time counter is longer than a predetermined time when the power source is turned on, wherein the toner removal controller determines whether or not the difference between an absolute humidity detected by the humidity detector and an absolute humidity stored in the storage portion is more than the predetermined difference value only when the time determining portion determines that the elapsed time is longer than the predetermined time.

7. A method for forming an image, comprising:

a first humidity detecting step of detecting an absolute humidity;

a toner intensity controlling step of changing, in accordance with a change in the absolute humidity detected in the first humidity detecting step, the toner density of a developing device for storing developer particles including toner particles;

a storage controlling step of storing in a storage portion an absolute humidity detected in the first humidity detecting step, and controlling the storage portion to maintain the absolute humidity detected in the first humidity detecting step when the power source is turned off;

a power turning-off step of turning off a power source;

a power turning-on step of turning on the power source;

a second humidity detecting step of detecting an absolute humidity when the power source is turned on in the power turning-on step; and a toner removing step of removing residual toner particles from the developing device when a difference between an absolute humidity in a power-on state detected in the second humidity detecting step and an absolute humidity in a power-off state stored in the storage portion is more than a predetermined difference value.

* * * * *